US005497564A

United States Patent [19]

Allen et al.

[11] Patent Number: 5,497,564

[45] Date of Patent: Mar. 12, 1996

[54] RIGID/SEMI-RIGID PLASTIC SHOE STRAP CONSTRUCTION

[75] Inventors: Bernie Allen, Wayland; Joel Rusnak, Newburyport; Aaron Azevedo, Boston; Neal Kimball, Framingham, all of Mass.

[73] Assignee: Converse Inc., North Reading, Mass.

[21] Appl. No.: 86,948

[22] Filed: Jul. 2, 1993

[51] Int. Cl.[6] ..... A43C 11/00; A43C 5/00

[52] U.S. Cl. ..... 36/50.1; 36/45; 24/713.7; 24/713.8

[58] Field of Search ..... 36/84, 88, 91, 36/50.1, 45; 24/714.3, 713, 713.2, 713.6, 713.8, 715.4; 2/338, 266

[56] References Cited

U.S. PATENT DOCUMENTS

| | | | |
|---|---|---|---|
| 2,982,003 | 5/1961 | Bingham, Jr. | 36/45 |
| 3,328,854 | 7/1967 | Tombari | 24/713.7 |
| 3,997,386 | 12/1976 | Oshida et al. . | |
| 4,282,657 | 8/1981 | Antonious | 36/114 |
| 4,413,431 | 4/1983 | Cavanagh | 36/45 |
| 4,447,967 | 5/1984 | Zaino | 36/87 |
| 4,637,381 | 1/1987 | Jungmann . | |
| 4,670,998 | 6/1987 | Pasternak | 36/50.1 |
| 4,756,098 | 7/1988 | Boggia | 36/114 |
| 4,811,500 | 3/1989 | Maccano . | |
| 4,813,158 | 3/1989 | Brown | 36/114 |
| 4,924,605 | 5/1990 | Spademan | 36/88 |
| 5,006,385 | 4/1991 | Cheung et al. . | |
| 5,175,947 | 1/1993 | Parracho | 36/88 |
| 5,184,378 | 2/1993 | Batra | 36/50.1 |

FOREIGN PATENT DOCUMENTS

| | | | |
|---|---|---|---|
| 0212032 | 3/1987 | European Pat. Off. | 36/88 |

*Primary Examiner*—Paul T. Sewell
*Assistant Examiner*—Marie Denise Patterson
*Attorney, Agent, or Firm*—Rogers, Howell & Haferkamp

[57] ABSTRACT

A shoe construction employs straps formed of plastic material whereby separate areas of the shoe straps have different characteristics of elasticity, flexibility and rigidity. The construction of the strap provides areas connected to the shoe with greater elasticity and flexibility characteristics and a lesser rigidity characteristic than a second area of the strap that has greater rigidity characteristics and is connected to closure members of the shoe.

20 Claims, 3 Drawing Sheets

RIGID/SEMI-RIGID PLASTIC SHOE STRAP CONSTRUCTION

BACKGROUND OF THE INVENTION (1) Field of the Invention

The present invention pertains to a shoe construction employing straps formed of plastic material whereby separate areas of the shoe straps have different characteristics of elasticity, flexibility and rigidity. In particular, the present invention pertains to a shoe construction employing straps that extend over the shoe (either beneath or within the material of the shoe upper or over the material of the upper) and are constructed of a plastic material whereby an area of each strap connected to the shoe has greater elasticity and flexibility and lesser rigidity than a second area of each strap that connects to closure means of the shoe.

(2) Description of the Related Art

Various different types of flexible and elastic materials have been employed in the construction of shoes, both shoe soles and shoe uppers. Some of the more rigid plastic materials have been used in shoe construction, for example in shoe soles and heel counters, due to their strength properties. What is meant herein by plastic materials is plastics that go through a phase transformation from a solid to a liquid when subjected to significant heat, and are therefore capable of being molded into desired configurations.

Plastics having appreciable elasticity and flexibility characteristics would be well suited for use in the construction of shoe uppers, particularly for athletic shoes, the uppers of which are often stretched and flexed repeatedly in use. However, increased elasticity and flexibility characteristics of plastics correspondingly reduce the rigidity characteristics of plastics. Plastics having good elasticity and flexibility for use in shoe uppers typically do not have the rigidity or strength characteristics required for use in the typical construction of shoe uppers. Forming eyelets for shoe lacing or similar apertures for adjustable bands used as closures on shoes in a plastic material having significant elastic and flexibility characteristics would most likely result in the eyelets or other closure aperture being torn through the plastic material over a period of use of the shoe.

SUMMARY OF THE INVENTION

The present invention seeks to provide an improved shoe strap construction that combines elasticity, flexibility and rigidity characteristics of two different types of plastic materials in a single shoe strap construction. The present embodiment of the invention provides a shoe strap construction of various different configurations where a first area of each strap is constructed of a plastic material having greater elasticity and flexibility characteristics and a lesser rigidity characteristic than a second plastic material used in a second area of the shoe strap construction. The area of the shoe strap having enhanced elasticity and flexibility is secured to the shoe in any desired location, for example stitched or adhered to the upper or adhered or molded into the shoe sole. The strap may extend over, beneath or through the material of the shoe upper at an instep, forefoot or heel counter area of the shoe upper or all of these areas. The area of the shoe strap construction having greater rigidity but lesser elasticity and flexibility is located at one or more distal ends of the strap where closure members, such as shoe lacing or adjustable bands, are passed through one or more holes provided through the more rigid second area of the strap, whereby the enhanced rigidity of this area of the strap prevents the closure member holes from tearing through the strap over prolonged use of the shoe.

In the preferred embodiment of the invention, each strap is constructed with one or more insets formed of the second plastic material having the greater rigidity and lesser elasticity and flexibility. The insets are encapsulated in the first plastic material of the strap having the greater elasticity and flexibility but lesser rigidity. By encapsulating the inset in the first plastic material in the strap, a secure chemical bond is formed between these two different plastic materials that prevents them from being separated from each other during prolonged use of the shoe. Alternatively, the inset may be adhered to the first plastic material of the strap. The first plastic material provides the shoe strap with the elasticity and flexibility characteristics desired of shoe strap construction where the second plastic material provides the shoe strap with the desired rigidity characteristics in the areas of the shoe strap attached to closure members where greater strength of the strap material is required.

BRIEF DESCRIPTION OF THE DRAWINGS

Further objects and features of the present invention are revealed in the following detailed description of the preferred embodiments of the invention and in the drawing figures wherein.

DESCRIPTION OF THE PREFERRED EMBODIMENTS

Figure 1:
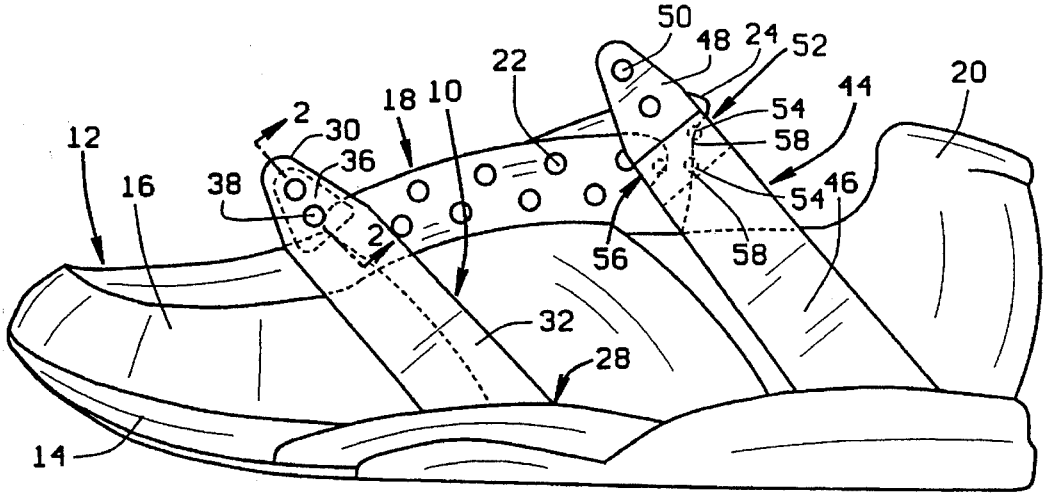
FIG. 1 is a side elevation view of a shoe employing the shoe strap construction of the present invention.

FIG. 1 shows an operative environment of a first embodiment of the shoe strap 10 of the present invention. FIG. 1 shows the shoe strap 10 employed on an athletic shoe. It should be understood that the shoe 12 is illustrative only of one type of shoe with which the shoe strap 10 of the invention may be employed. The shoe strap 10 may be used with a variety of different types of shoes having a variety of different configurations other than that shown in the drawing figures.

The shoe 12 comprises a shoe sole 14 and a shoe upper 16 connected to the sole, the upper 16 having an exterior surface with an instep area 18 and a heel counter area 20. A row of lacing eyelets 22 is provided around a front opening in the shoe instep area 18 as is conventional. A tongue 24 is positioned beneath the front opening of the shoe upper. Although only one side of the shoe is visible in FIG. 1, it should be understood that the shoe's construction may be substantially symmetric or asymmetric on opposite sides of the longitudinal axis of the shoe. The shoe straps of the invention may be employed in addition or alternative to the existing closure means of the shoe.

The shoe strap 10 of the invention is generally comprised of two different types of plastic materials, meaning that the two types of materials have different characteristics of elasticity, flexibility and rigidity. The two types of materials may actually be the same plastic, but with different characteristics. Alternatively, the different characteristics may be achieved by using two different plastics. In the illustrative examples shown and described herein, the plastic materials are preferably different types of thermoplastic polyurethane (TPU) having different characteristics of elasticity, flexibility and rigidity.

As seen in FIG. 1, the strap 10 has an elongate configuration. A proximal end 28 of the strap is secured to the shoe and the length of the strap extends over the exterior surface of the shoe upper 16 to the strap's distal end 30. In variant embodiments of the strap shown in the drawing figures, the strap may extend beneath or through the material of the shoe upper and the illustrated positioning of the strap on the shoe should not be interpreted as limiting. As stated earlier, the strap is constructed of two different types of plastic materials with the two different materials being located in two different areas of the strap. The first plastic material, having greater elasticity and flexibility characteristics and a lesser rigidity characteristic than the second material of the strap, is employed in constructing the first area 32 of the strap which constitutes a majority of the strap's length. The second plastic material, having lesser elasticity and flexibility characteristics and a greater rigidity characteristic than the first plastic material, is employed in constructing an inset 36 that constitutes the second area of the strap. The second plastic material is stronger than the first plastic material in resisting tears. As seen in FIG. 1, the inset 36 that makes up the second area of the strap is located adjacent the distal end 30 of the strap. The inset 36 is shown having a generally triangular configuration; however, the configuration of the inset 36 may be varied depending on the overall configuration of the strap. With the strap 10 having the elongated configuration shown in FIG. 1, the general triangular shape of the inset 36 is well suited for receipt of the inset at the distal end of the strap.

Figure 2:
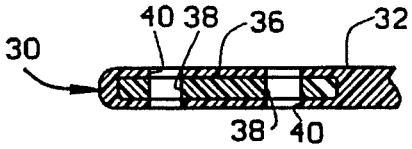
FIG. 2 is a partial view, in section, of the shoe strap of the invention taken along the line 2—2 of FIG. 1.

The inset 36 is secured to the strap 10 by being molded into the first plastic material of the strap as the strap is formed. This results in the inset 36 being completely encapsulated inside the first plastic material of the strap 10 as shown in FIG. 2. The encapsulation of the inset 36 inside the first plastic material of the strap provides a strong connection between the inset and strap that prevents the inset from being pulled apart from the strap in prolonged use of the shoe. The inset 36 is provided with a pair of lacing holes 38 for receiving conventional shoe lacing. Alternatively, an oblong slot could have been provided in the inset 36 to receive an adjustable band if such a band is employed in place of conventional shoe lacing on the shoe with which the strap 10 is employed. The lacing holes 38 extend completely through the inset 36 and align with holes 40 in the first plastic material encapsulating the inset.

The shoe strap 10 having the construction described above combines the desirable characteristics of the two different plastic materials into a single, integral strap construction. With the strap first area 32, constituting a majority of the strap's length, being constructed of the first plastic material having the greater elasticity and flexibility characteristics of the two materials, the strap may be pulled and stretched tight over the upper exterior surface at the instep area 18 of the shoe. In the variant embodiments of the strap extending beneath or through the material of the shoe upper, an aperture is provided on the shoe upper through which the distal end of the strap projects. Pulling the exposed end of the strap will stretch the first plastic material of the strap tight over the shoe wearer's foot. The second area of the strap, constituted by the inset 36, having the greater rigidity characteristic of the two plastic materials employed in constructing the strap, enables lacing or other closure means to be inserted through the inset holes 38 to pull the strap tight across the exterior surface (or beneath or through the interior) of the shoe upper 16 with the rigidity characteristic of the inset 36 insuring that the inset holes 38 do not tear from the forces exerted by the lacing inserted through the eyelets over prolonged use of the shoe.

In variant embodiments of the strap 10, a rigid material other than a plastic material may be employed in constructing the inset 36, with the first plastic material having good elasticity and flexibility characteristics still being employed in constructing the first area 32 of the strap. Because elasticity and flexibility is not required of the inset 36, rigid materials other than plastic materials may be employed in its construction.

In use of the strap 10 in shoe construction, a pair of like straps may be attached to the opposite lateral and medial sides of the shoe in the manner shown of the strap 10 in FIG. 1, with the strap proximal end 28 secured to the shoe and the length of the strap extending to the distal end 30 out over, beneath or through the material of the shoe upper instep area 18. The strap proximal end 28 may be secured to the shoe by stitching or adhesives or may be molded integrally to the shoe sole 14. Conventional shoe lacing or other closure means are inserted through the inset eyelets 38 of the two straps on opposite sides of the shoe and are pulled tight to stretch the two straps 10 over the opposite sides of the shoe. In variant embodiments, only one strap 10 is secured on one side of the shoe and the shoe lacing or other closure means are inserted through the inset eyelets 38 and eyelets secured to the shoe construction on the opposite side of the shoe upper and pulled tight to stretch the single strap 10 over the exterior surface of the shoe.

The strap 44 shown in FIG. 1 extending from the shoe sole 14 toward the shoe tongue 24 is a variant embodiment of the strap 10. As in the first strap 10, the second strap 44 has an elongate configuration with a majority of, or a first area 46 of the strap being constructed of the first plastic material having the greater elasticity and flexibility characteristics and lesser rigidity characteristic than a second area 48 of the strap at its distal end. The second area of the strap 48 comprised of the second plastic material having the lesser elasticity and flexibility characteristics and the greater rigidity characteristic is formed as a tab having a general triangular configuration that is secured to the distal end of the first plastic material area 46 of the strap. The tab 48 is provided with a pair of lacing eyelets 50 and functions in substantially the same manner as the inset 36 of the first strap 10. However, the tab 48 is not encapsulated in the first plastic material as was the inset, but is molded to the distal end of the first plastic material area 46 of the strap. As seen in the drawing figure, the tab 48 is formed with a necked down portion 52 having a plurality of lugs 54 formed thereon. The tab, the necked down portion 52 and the lugs 54 are all formed of the second plastic material. The distal end of the strap first area 46 is also formed with a necked down portion 56 having a plurality of holes 58 formed therein to receive the tab lugs 54. In connecting the tab 48 to the first area of the strap 46, the tab lugs 54 are inserted through the strap holes 58 and the tab and the strap first area are subjected to heat, causing the necked down portions of the tab and strap 52, 56 to fuse together, thereby forming an integral strap construction. As in the first described strap 10, the strap 44 combines the desirable characteristics of rigidity and strength of the tab 48 surrounding the tab eyelets 50 with the elasticity and flexibility of the strap first area 46. The strap 44 is secured to the shoe in the same manner as the first described strap 10 and is employed in being stretched and secured over the exterior surface of the shoe in the same manner as that as the first described strap 10.

The strap 60 shown in FIG. 2 is secured to a shoe 12 substantially identical to the shoe of the first described embodiment and has a construction similar to that of the first described strap 10. The strap 60 has a greater width than the first strap 10, and also has an elongate configuration with a proximal end 62 of the strap secured to the shoe and a distal end 64 positioned extending out over, beneath or through the material of the shoe upper instep area 18 in the same manner as the first described strap 10. As in the first described embodiment, the majority of the strap 60 is comprised of a first area 66 constructed of the first plastic material having the greater elasticity and flexibility characteristics and a lesser rigidity characteristic than a second area 68 of the strap. The second area of the strap is occupied by an inset 68 constructed of the second plastic material having lesser elasticity and flexibility characteristics and a greater rigidity characteristic than the first area 66 of the strap. The inset 68 of the FIG. 3 embodiment has an elongate configuration that extends across the distal end 64 of the strap and is provided with a plurality of lacing eyelets 70 arranged along its length. As described earlier, the lacing eyelets 70 may be replaced by oblong apertures configured to receive adjustable bands inserted through the apertures to pull the strap across the exterior surface of the shoe upper. The inset 68 is completely encapsulated in the first plastic material in the strap as is shown in FIG. 4. Holes 72 are provided through the first plastic material and align with the lacing eyelets 70 of the inset. Beside the configuration of the strap 60 shown in FIG. 3, the strap 60 differs from the first described strap 10 in that it is provided with an opening 74 in the first area 66 of the strap that is covered over by a mesh material 76. The mesh material 76 has elasticity and flexibility characteristics that enable it to stretch with the first plastic material making up the first area 66 of the strap. The mesh material 76 enables ventilation of the area of the shoe wearer's foot beneath the mesh.

Figure 3:
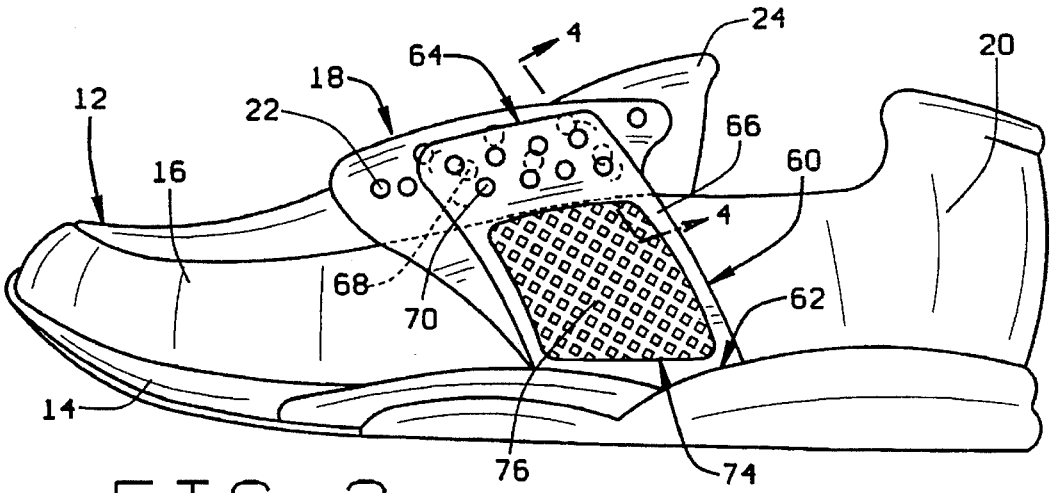
FIG. 3 is a side elevation view of a shoe employing a second embodiment of the shoe strap construction of the inventions.
Figure 4:
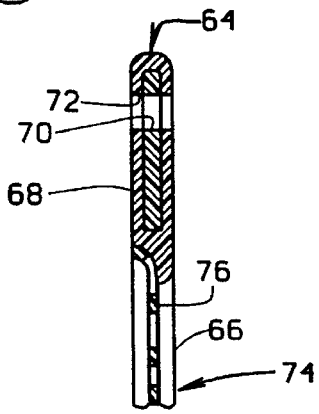
FIG. 4 is a partial view, in section, taken along the line 4—4 of FIG. 3.

As in the first described embodiment of the strap, the construction of the strap shown in FIG. 3 combines the desirable elasticity and flexibility characteristics of the first plastic material employed in constructing the first area 66 of the strap with the desirable rigidity and strength characteristic of the second plastic material employed in constructing the second area or inset 68 of the strap. The encapsulation of the inset 68 in the first plastic material of the first area 66 of the strap provides a secure connection between the inset and the strap and the rigidity and strength characteristics of the inset prevent the inset lacing eyelets 70 from tearing out due to forces exerted on the eyelets by lacing or other closure means over prolonged use of the shoe. The embodiment of the strap 60 shown in FIG. 3 may be employed with a shoe in the same manner as the first described strap 10 in that it may be employed in pairs with each strap positioned on opposite sides of the shoe or it may be employed as a single strap that is secured by lacing or other closure means over the instep area 18 of the shoe to eyelets or other apertures provided on the shoe upper on the opposite side of the shoe.

Figure 5:
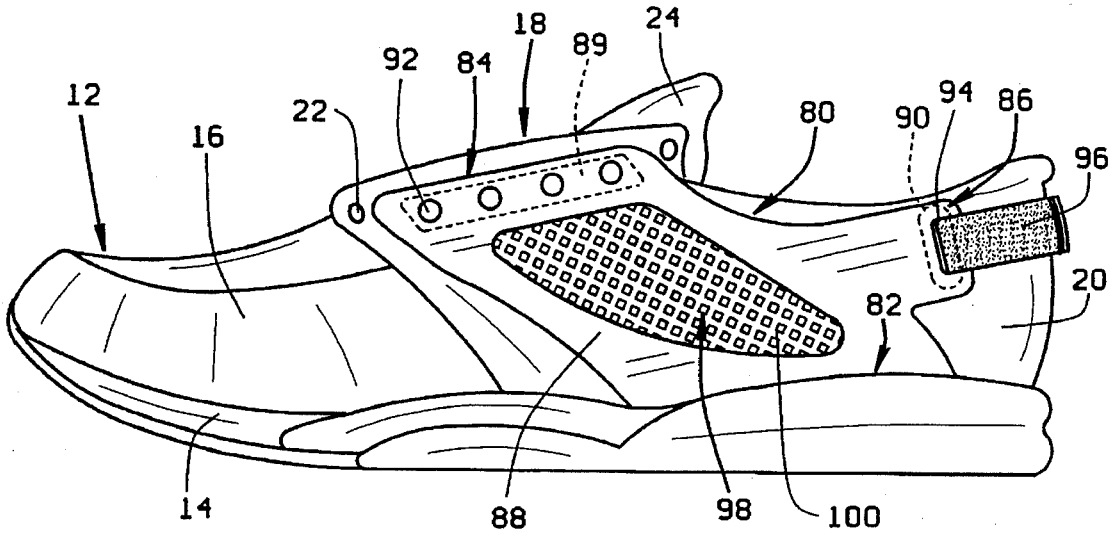
FIG. 5 is a side elevation view of a shoe employing a third embodiment of the shoe strap construction of the present invention.
Figure 6:
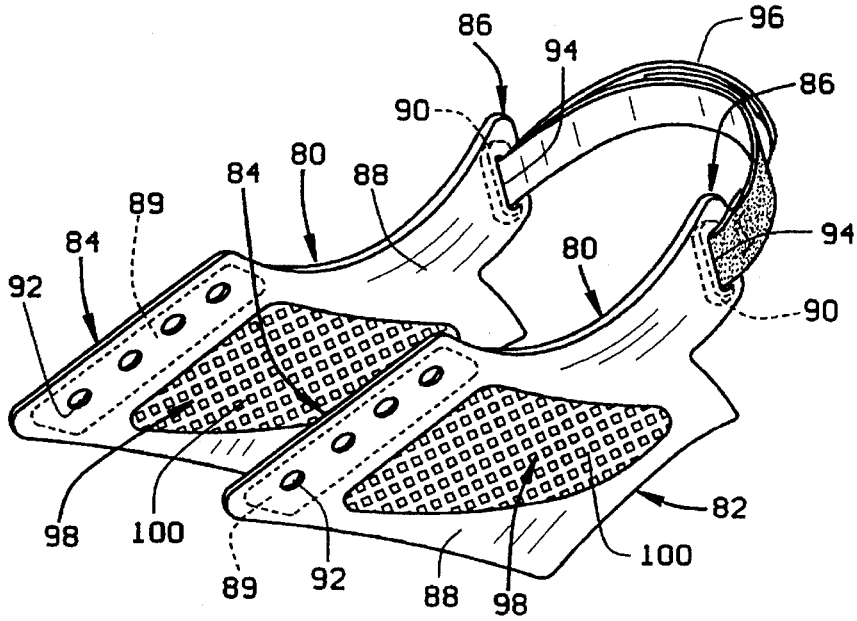
FIG. 6 is a perspective view of the shoe strap of the invention removed from the shoe shown in FIG. 5.

A still further embodiment of the shoe strap 80 of the present invention is shown in FIGS. 5 and 6 of the drawings. The strap construction 80 shown in FIGS. 5 and 6 is employed on substantially the same shoe 12 of the previously described embodiments. The configuration of the strap 80 shown in FIGS. 5 and 6 is similar to that of the strap 60 shown in FIGS. 3 and 4 except that it is provided with an additional distal end extension that projects toward the heel counter 20 of the shoe. As in the embodiment of FIGS. 3 and 4, the strap 80 has a widened width and an elongated configuration with the proximal end 82 of the strap secured to the shoe in the same manner as the previously described embodiments. The strap extends from its proximal end 82 to a first distal end 84 of the strap positioned over the upper opening at the instep area 18 of the shoe and to a second distal end 86 projecting over the heel counter 20 of the shoe. The strap 80 is constructed with a first area 88 constituting a majority of the strap's elongated configuration being constructed of the first plastic material having the greater elasticity and flexibility characteristics and a lesser rigidity characteristic than second areas 89, 90 of the strap. The second areas of the strap are occupied by a pair of insets 89, 90, both constructed of the second plastic material having lesser elasticity and flexibility characteristics and greater strength and rigidity characteristics than the first plastic material that makes up the first area 88 of the strap. The first inset 89 encapsulated in the distal end of the strap 84 over the instep area 18 of the shoe upper is constructed in substantially the same elongate configuration as the inset of FIG. 3. The inset 89 is also provided with a plurality of lacing eyelets 92 that extend through the inset and the first plastic material encapsulating the inset. The eyelets are provided for shoe lacing that is inserted through the eyelets and pulled tight to stretch the first distal end 84 of the strap 80 over the exterior surface of the shoe in the area of the shoe upper instep 18. As in the previously described embodiments, the strength characteristics of the second plastic material employed in constructing the inset 89 ensure against the eyelets 92 being torn out as the lacing is pulled tight over the shoe and over prolonged use of the shoe. The second inset 90 is encapsulated in the first plastic material at the second distal end 86 of the strap in the same manner as the insets of the previously described embodiments. The second inset 90 is provided with an oblong aperture 94 through its center that also extends through the first plastic material encapsulating the inset. The aperture 94 is dimensioned to provide access of an adjustable band 96 therethrough, the length of which can be adjusted to stretch the second distal end 86 of the strap first area 88 over the heel counter 20 of the shoe. The rigidity and strength characteristics of the second inset 90 prevent the aperture 94 from tearing out as the band 96 is pulled tight around the heel counter 20 and over prolonged use of the shoe. As in the embodiment of FIG. 3, the strap 80 is also provided with an opening 98 through the first plastic material of the first area 88 of the strap. The opening 98 is filled by an elastic mesh material 100 encapsulated in the material of the strap providing ventilation beneath the mesh.

FIG. 6 shows a pair of straps 80 removed from the shoe 12 and connected at their second distal ends 86 by the adjustable band 96. As in the previously described embodiments, it should be understood that the strap construction of FIG. 5 may be employed with only a single strap positioned on one side of the shoe which has its distal ends 84, 86 connected to eyelets or apertures on the opposite side of the shoe upper 16 by shoe lacing and/or adjustable bands.

In each of the described embodiments, the strap construction combines the desirable strength characteristics of a more rigid plastic material in the areas of the straps, i.e.

lacing eyelets and adjustable band apertures, where enhanced strength is required to prevent strap eyelets or apertures from tearing out over prolonged use of the shoe, with enhanced elasticity and flexibility characteristics of a less rigid plastic material employed in constructing a majority of the area of the strap. Each of the embodiments may be employed as a single strap on one side of the shoe or in pairs of straps on opposite sides of the shoe. Each of the embodiments may employ a first plastic material in the first area of the strap that can be seen through, enabling the encapsulated inset of the second plastic material to be seen through the first material of the strap. In each of the embodiments, the inset area may be constructed of a rigid material other than a plastic material with the first areas of the strap still being constructed of a first plastic material enabling the inset to be molded and encapsulated integrally into the construction of the strap.

Figure 7:
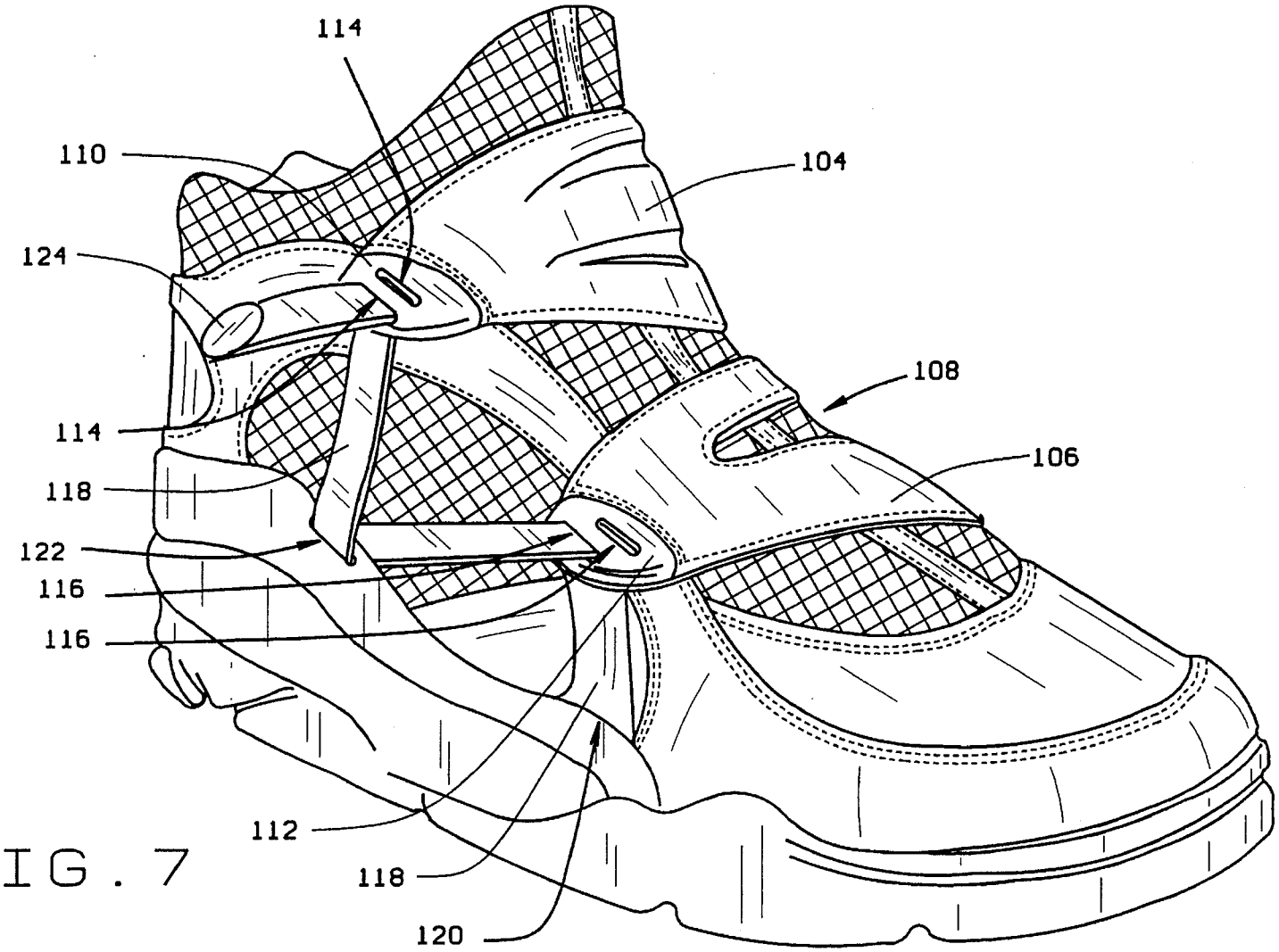
FIG. 7 is a perspective view of a still further embodiment of the shoe strap of the invention.

FIG. 7 shows still further embodiments of the shoe strap 104, 106 of the present invention. The pair of straps 104, 106 shown in FIG. 7 are substantially identical to each other except that the lower strap 106 has an opening 108 at its center. The configuration of the two straps 104, 106 is that they extend from an attachment at their proximal ends (not shown) on the opposite side of the shoe shown in the drawing figure to their distal ends, each having an inset 110, 112, respectively, encapsulated therein. As in the previously described embodiments, the insets 110, 112 are constructed of the second plastic material having enhanced rigidity and lesser elasticity and flexibility than the first plastic material that constitutes the majority of the strap lengths. Each of the insets 110, 112 are provided with a pair of apertures 114, 116, respectively. The apertures are provided for the strap 118 that is inserted through the apertures from its proximal end 120 secured to the shoe, through the aperture 116, through an aperture 122 in the shoe, through the second inlet aperture 114, to its distal end 124 where the band 118 is secured to the shoe upper. As in the previously described embodiments, the strength characteristics of the second plastic material employed in constructing the insets 110, 112 ensure against the apertures 114, 116 from being torn out as the band 118 is pulled tight on the side of the shoe or over prolonged use of the shoe. As stated earlier, the straps of first plastic material 104, 106 and their respective insets of second plastic material 110, 112 are constructed in substantially the same manner as the previously described embodiments of the invention.

While the present invention has been described by reference to specific embodiments, it should be understood that modifications and variations of the invention may be constructed without departing from the scope of the invention defined in the following claims.

What is claimed is:

1. A shoe having flexible and adjustable closure means, the shoe comprising:

a shoe sole having opposite lateral and medial sides;

a shoe upper secured to the shoe sole along its opposite lateral and medial sides, the upper having an interior surface that defines an interior volume of the shoe configured to receive a foot therein, and the upper having an exterior surface with opposite lateral and medial surfaces;

and at least one strap having an elongated configuration with a length of the strap having opposite proximal and distal ends, the proximal end being connected to one of the lateral and medial sides of the shoe and the strap extending along its length from the shoe at the strap proximal end, to the distal end of the strap, the strap being formed of first and second plastic materials giving different areas of the length of the strap different characteristics of elasticity, flexibility and rigidity, with a first area of the length of the strap adjacent the strap connection to the shoe having greater elasticity and flexibility and lesser rigidity characteristics than elasticity, flexibility and rigidity characteristics of a second area of the length of the strap adjacent the strap distal end; and, closure means connected to the distal end of the strap for adjustably pulling the length of the strap from its connection to one of the lateral and medial sides of the shoe toward the other of the lateral and medial sides of the shoe.

2. The shoe of claim 1, wherein:

an inset formed of the second plastic material is encapsulated in the first plastic material at the second area of the strap, and the closure means connects to the inset.

3. The shoe of claim 2, wherein:

the inset is completely encapsulated in the first plastic material at the second area of the strap, at least one hole extends through the inset and the first plastic material encapsulating the inset, and the closure means includes lacing inserted through the inset hole.

4. The shoe of claim 2, wherein:

the inset is completely encapsulated in the first plastic material at the second area of the strap, at least one hole extends through the inset and the first plastic material encapsulating the inset, and the closure means includes an adjustable band inserted through the inset hole.

5. The shoe of claim 2, wherein:

the first plastic material can be seen through whereby the inset is visible encapsulated in the first plastic material.

6. The shoe of claim 2, wherein:

a mesh material is secured in the first plastic material of the strap filling an opening of the strap that is spaced from the inset encapsulated in the first plastic material.

7. The shoe of claim 2, wherein:

the inset has an elongated configuration and a plurality of holes arranged in a row extend through the inset, and the closure means extends through the plurality of holes.

8. The shoe of claim 2, wherein:

the inset is a first inset and a second inset formed of the second plastic material is encapsulated in the first plastic material spaced from the first inset, and the closure means connects to the second inset.

9. A shoe having flexible and adjustable closure means, the shoe comprising:

a shoe sole having opposite lateral and medial sides;

a shoe upper secured to the shoe sole along its lateral and medial sides, the upper having an interior surface that defines an interior volume of the shoe configured to receive a foot therein, and the upper having an exterior surface with opposite lateral and medial surfaces;

a lateral strap secured to the lateral side Of the shoe and a medial strap connected to the medial side of the shoe; both the lateral, and medial straps extending to distal ends of the lateral and medial straps, both the lateral and medial straps being formed of plastic material whereby different areas; of the straps have different characteristics of elasticity and flexibility with first areas of the straps adjacent their connections to the shoe having elasticity and flexibility characteristics that are greater than elasticity and flexibility characteristics of second areas of the straps adjacent their distal ends;

closure means connected between the distal ends of the lateral an medial straps for adjustably pulling the distal ends toward each other;

the lateral and medial straps are both formed of at least first and second different types of plastic material at the first and second areas of the straps, respectively, whereby the second plastic material at the second areas of the straps has a greater characteristic of rigidity than the first plastic material at the first areas of the straps.

10. The shoe of claim 9, wherein:

the second plastic material is formed as an inset that is encapsulated in the first plastic material at the second area of each strap, and the closure means connects to the inset.

11. The shoe of claim 10, wherein:

the inset at the second area of each strap has at least one hole therethrough that also extends through the first plastic material encapsulating the inset, and the closure means includes lacing inserted through the inset hole.

12. The shoe of claim 10, wherein:

the inset at the second area of each step has at least one hole therethrough that also extends through the first plastic material encapsulating the inset, and the closure means includes an adjustable band inserted through the inset hole.

13. The shoe of claim 10, wherein:

the first plastic material can be seen through, whereby the insert is visible encapsulated in the first plastic material.

14. The shoe of claim 9, wherein:

the second plastic material is formed as a tab at the distal end of each strap, the tab being connected to the shoe by the first plastic material, and the closure means being connected to the tab.

15. The shoe of claim 14, wherein:

the tab at the distal end of each strap has at least one hole therethrough that is spaced from the connection of the tab to the first plastic material of the strap, and the closure means includes lacing inserted through the tab hole.

16. The shoe of claim 14, wherein:

the tab at the distal end of each strap has at least one hole therethrough that is spaced from the connection of the tab to the first plastic material of the strap, and the closure means includes an adjustable band inserted through the tab hole.

17. The shoe of claim 9, wherein:

the lateral and medial straps are connected at their distal ends by closure means that extend over instep areas of the shoe upper lateral and medial surfaces.

18. The shoe of claim 9, wherein:

the lateral and medial straps are connected at their distal ends by closure means that extend over a heel area of the shoe upper exterior surface.

19. The shoe of claim 17, wherein:

the lateral and medial straps are also connected at their distal ends by closure means that extend over a heel area of the shoe upper exterior surface.

20. A shoe having flexible and adjustable closure means, the shoe comprising:

a shoe sole having opposite lateral and medial sides;

a lateral strap secured to the lateral side of the shoe and a medial strap connected to the medial side of the shoe, both the lateral and medial straps having elongated configurations with lengths extending between oppositely spaced proximal and distal ends of the lateral and medial straps, the proximal ends of the straps are connected to the shoe, both the lateral and medial straps being formed of plastic material whereby different areas of the straps adjacent the proximal and distal ends have different characteristics of elasticity and flexibility with first areas of the straps adjacent the proximal ends' connections to the shoe having elasticity and flexibility characteristics that are greater than elasticity and flexibility characteristics of second areas of the straps adjacent the distal ends, the lateral and medial straps both being formed of at least first and second different types of plastic material at the first and second areas of the straps, respectively, whereby the second plastic material at the second areas of the straps has a greater characteristic of rigidity than the first plastic material at the first areas of the straps; and, closure means connected between the distal ends of the lateral an medial straps for adjustably pulling the distal ends toward each other.

* * * * *